US006449863B1

(12) United States Patent
Voorhees

(10) Patent No.: US 6,449,863 B1
(45) Date of Patent: Sep. 17, 2002

(54) METHOD AND APPARATUS FOR ALIGNING A WALL HANGING

(76) Inventor: Terry D. Voorhees, 10 Ocean Blvd., Apt. 4E, Atlantic Highlands, NJ (US) 07716

( * ) Notice: Subject to any disclaimer, the term of this patent is extended or adjusted under 35 U.S.C. 154(b) by 41 days.

(21) Appl. No.: 09/655,245

(22) Filed: Sep. 5, 2000

(51) Int. Cl.[7] ..... G01B 3/14; A47G 1/24

(52) U.S. Cl. ..... 33/613; 33/563; 248/495

(58) Field of Search ..... 33/1 B, 1 G, 562, 33/563, 566, 613, 645; 248/466, 475.1, 489, 490, 495, 496

(56) References Cited

U.S. PATENT DOCUMENTS

| | | | | | |
|---|---|---|---|---|---|
| 409,644 | A | * | 8/1889 | Messer | 248/496 |
| 2,686,641 | A | * | 8/1954 | Friedrich | 248/490 |
| 2,952,431 | A | * | 9/1960 | Pedley | 248/495 |
| 3,516,165 | A | * | 6/1970 | Pfeffer | 33/520 |
| 4,162,056 | A | * | 7/1979 | Moorhead | 248/495 |
| 4,241,510 | A | * | 12/1980 | Radecki | 33/613 |
| 4,336,884 | A | * | 6/1982 | Hart et al. | 206/575 |
| 4,443,949 | A | * | 4/1984 | Newton | 33/562 |
| 4,549,713 | A | * | 10/1985 | Magadini | 248/495 |
| 4,593,804 | A | * | 6/1986 | Kinsey et al. | 33/562 |
| 5,069,411 | A | * | 12/1991 | Murphy | 248/495 |
| 5,076,612 | A | * | 12/1991 | Nirmel | 33/563 |
| 5,425,524 | A | | 6/1995 | Messina, Jr. | 248/475.1 |
| 5,802,729 | A | | 9/1998 | O'Brien et al. | 33/371 |
| 5,819,422 | A | * | 10/1998 | Schafer | 33/1 B |
| 5,933,973 | A | | 8/1999 | Fenley, Jr. | 33/451 |
| 5,992,813 | A | | 11/1999 | Keers | 248/489 |
| 6,003,825 | A | * | 12/1999 | Abernathy, Jr. | 248/496 |
| 6,026,584 | A | | 2/2000 | Wegman | 33/613 |
| 6,049,987 | A | * | 4/2000 | Robell | 33/1 B |
| 6,095,478 | A | | 8/2000 | Barnes | 248/475.1 |

* cited by examiner

*Primary Examiner*—G. Bradley Bennett
(74) *Attorney, Agent, or Firm*—Moser, Patterson & Sheridan, LLP

(57) ABSTRACT

A system and method for aligning an object to be hung on a wall and for determining the points upon the wall which will receive an anchor to secure the object.

11 Claims, 9 Drawing Sheets

METHOD AND APPARATUS FOR ALIGNING A WALL HANGING

The invention relates to a method and apparatus for hanging a picture, mirror or other object on a wall.

BACKGROUND OF THE INVENTION

It is clearly desirable to hang pictures, mirrors and other objects on walls in a manner that is pleasing to the eye of even a casual observer. In the case of a plurality of objects hung in a manner intended to be aligned, even minor errors in alignment are noticeable. Therefore, decorators take great care in insuring that wall hangings are appropriately arranged to avoid even the slightest alignment error. Importantly, proper hanging of pictures and mirrors greatly reduces the warping of picture frames and the need for constant straightening of the picture or mirror.

Many pictures, mirrors and other wall hangings are secured using one or more wall anchors, such as nails, screws or special purpose hanging brackets, that catch or otherwise mechanically communicate with a wire horizontally disposed, and attached to, the rear or "wall side" of the picture, mirror or object to be hung. Thus, in addition to attempting to insure alignment of the various objects to be hung, a decorator must also control the relative position of the wall hanging brackets and the wire used to secure the wall hanging. In the case of mirrors, non-wire mounting is typically provided by including fixed mounting hardware on the back of a mirror which may or may not be properly aligned, thereby leading to poor hanging alignment. This situation is typically resolved by repeated moving of one or more objects after an initial hanging of the object on the wall, resulting in possible damage to the wall and/or object to be hung. Additionally, two people are typically required to hang a picture unless the picture is very small.

Therefore, it is seen to be desirable to provide a system and method for aligning an object to be hung on a wall and for determining a priori the points upon the wall which will receive an anchor, prior to hanging the object on the wall.

SUMMARY OF THE INVENTION

The invention comprises a system and method for aligning an object to be hung on a wall and for determining the points upon the wall which will receive an anchor to secure the object. Additionally, the invention may be readily adapted to work with mirror hangers, which do not use a hanging wire, such that mirrors may be hung in a straight manner even if the non-wire hangers are not accurately positioned on the back of the mirror.

DETAILED DESCRIPTION

Figure 1:
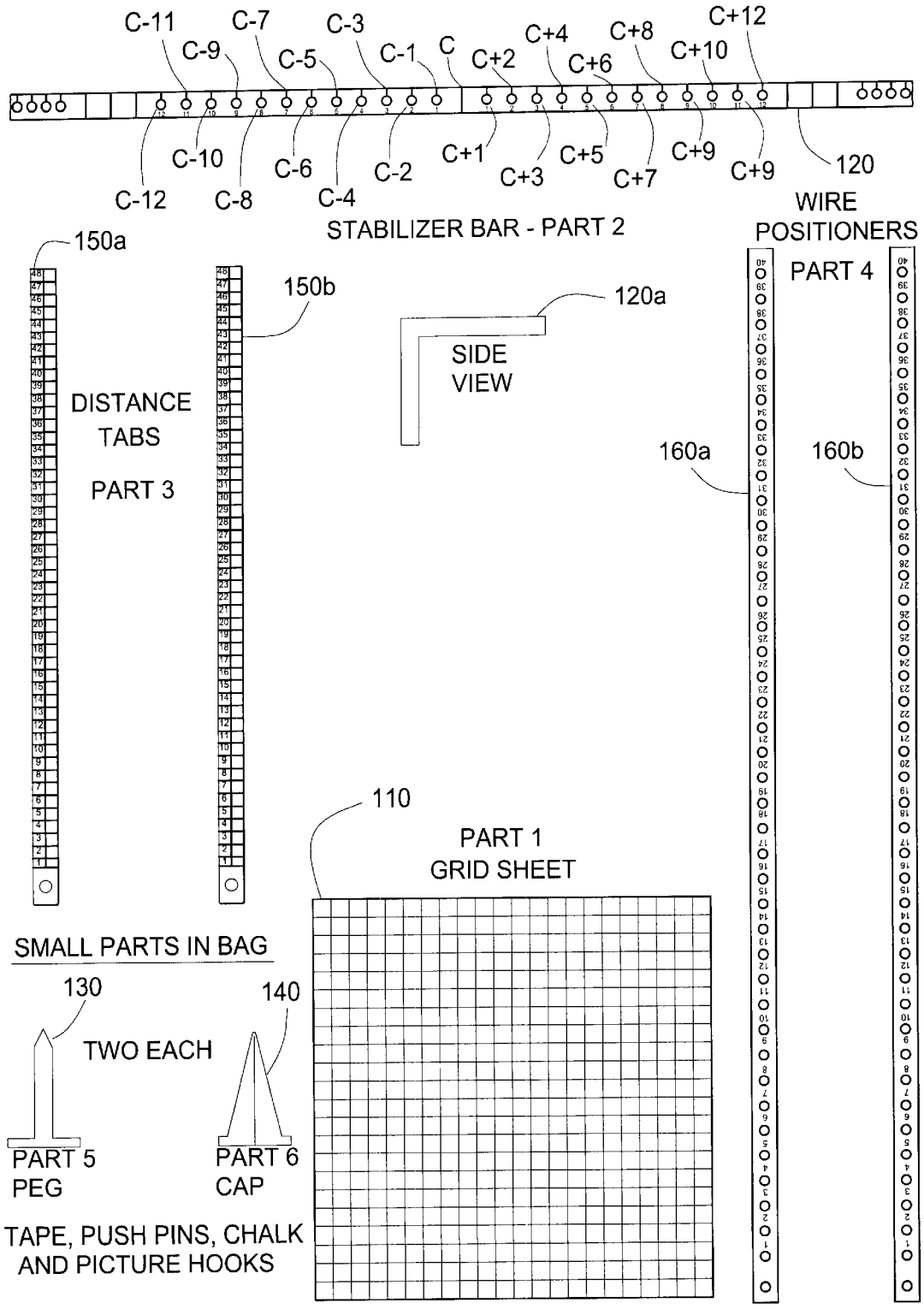
FIG. 1 depicts an exemplary grouping of components suitable for use in a method according to the present invention.

FIG. 1 depicts an exemplary grouping of components suitable for use in practicing a method according to the present invention. The exemplary components comprise a sheet or grid sheet 110, a stabilizer bar 120, a plurality of pegs 130, an optional plurality of peg caps 140, a plurality of distance tabs 150 and a plurality of wire positioners 160. Specifically, a grid sheet 110 comprises a relatively large piece of paper or other thin sheet material having preferably disposed or inscribed thereon a grid pattern.

The stabilizer bar 120 comprises a strip or angular extrusion of a resilient material such as plastic including a center marking (C) and a plurality of distance markings emanating from the center marking and approaching respective end markings (C+1, C+2 . . . C+N) (C−1, C−2 . . . C−N) on either end of the stabilizer bar. It is noted that each of the distance markings has associated with it a respective hole adapted to receive a peg 130. In the exemplary embodiment of the invention, the stabilizer bar comprises an angular plastic bar having markings disposed every inch with holes at each marking. The preferred stabilizer bar 120 has a preferred side view 120A. A straight stabilizer base 120 may be used (i.e., non-angular), though a straight stabilizer base 120 is not as effective as the angular stabilizer base due to possible movement of the stabilizer base during the various alignment steps discussed in more detail below.

The distance tabs 150 and wire positioners 160 comprise strips of a thin sheet material such as paper or Mylar having a first perforation or hole at one end adapted to receive the peg 130. Preferably, the distance tabs 150 include a plurality of equi-distantly spaced markings indicative of length and emanating from the first perforation or hole. While such markings are not necessary to practice the invention, the markings are perforated and do assist a user practicing the invention. The wire positioners 160 comprise a similar plurality of equidistantly spaced holes adapted to receive pegs 130 emanating from a first hole at a respective first end of the wire positioners 160. In the preferred embodiment, the wire positioners 160 and distance tabs 150 include perforations at each of the equidistantly spaced markings. The perforations are appropriately sized to receive the pegs 130.

The pegs 130 are of sufficient length to penetrate the holes within the stabilizer bar 120, distance tabs 150 and wire positioners 160. The pegs optionally receive a peg cap 140, which may be used to secure the stabilizer bar 120, distance tabs 150 and wire positioners 160 to a peg 130 protruding through their respective holes.

The sheet or grid sheet 110 comprises a thin sheet material such as paper preferably including a grid pattern to assist in appropriately aligning the various components. Moreover, when such a grid sheet is placed against a wall for positioning, the various grid lines assist the decorator in determining whether the picture to be hung, if hung in the position indicated by the grid sheet on the wall, is level. Thus, the grid sheet may be adapted to include visual indications suitable for assisting a decorator in determining whether a picture is level and vertically true. Such indications may include multiple colors, horizontal-only striations, vertical-only striations, grid patterns and the like.

Figure 2A:
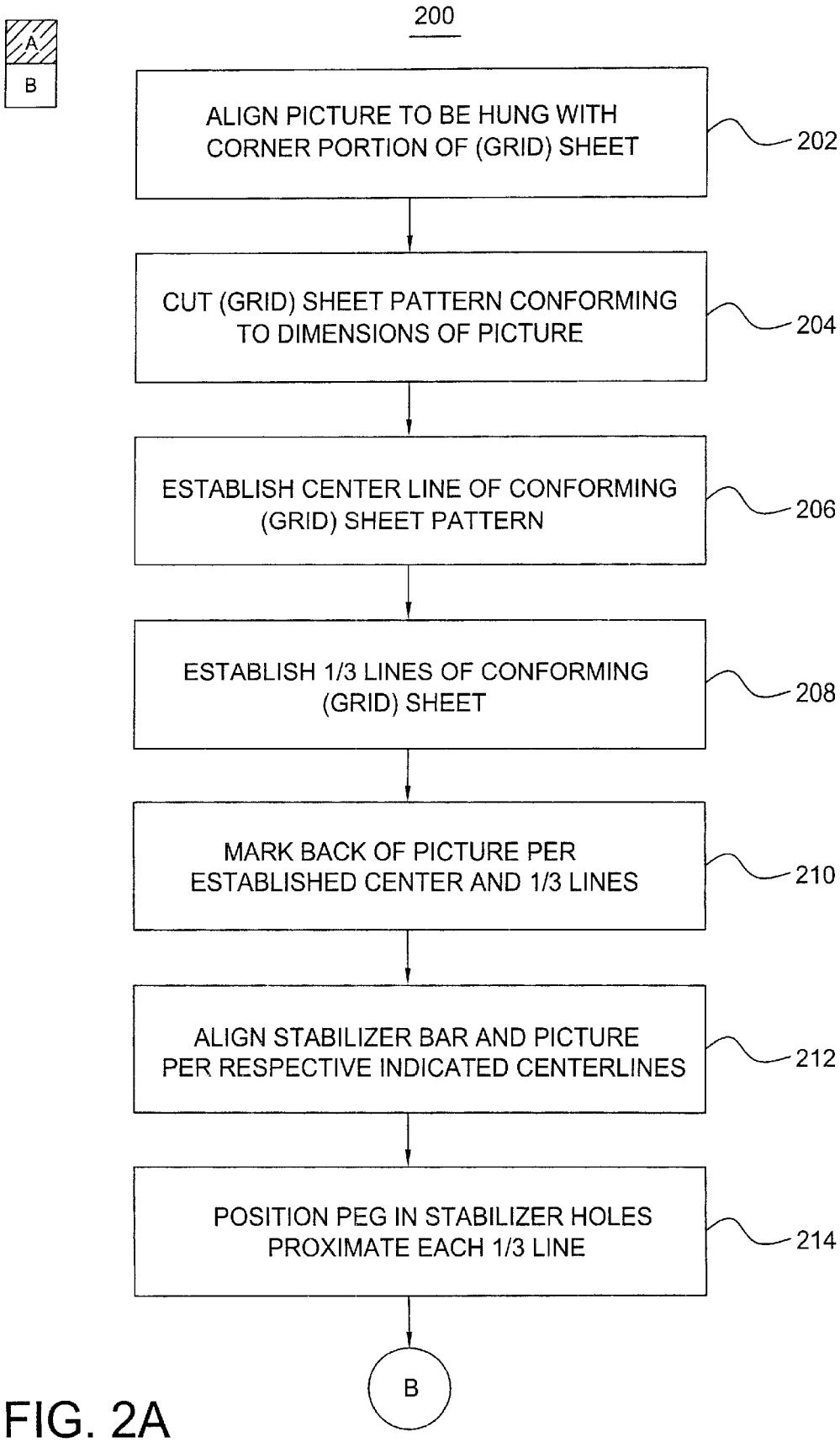
FIG. 2 depicts a flow diagram of a method according to an embodiment of the present invention.
Figure 2B:
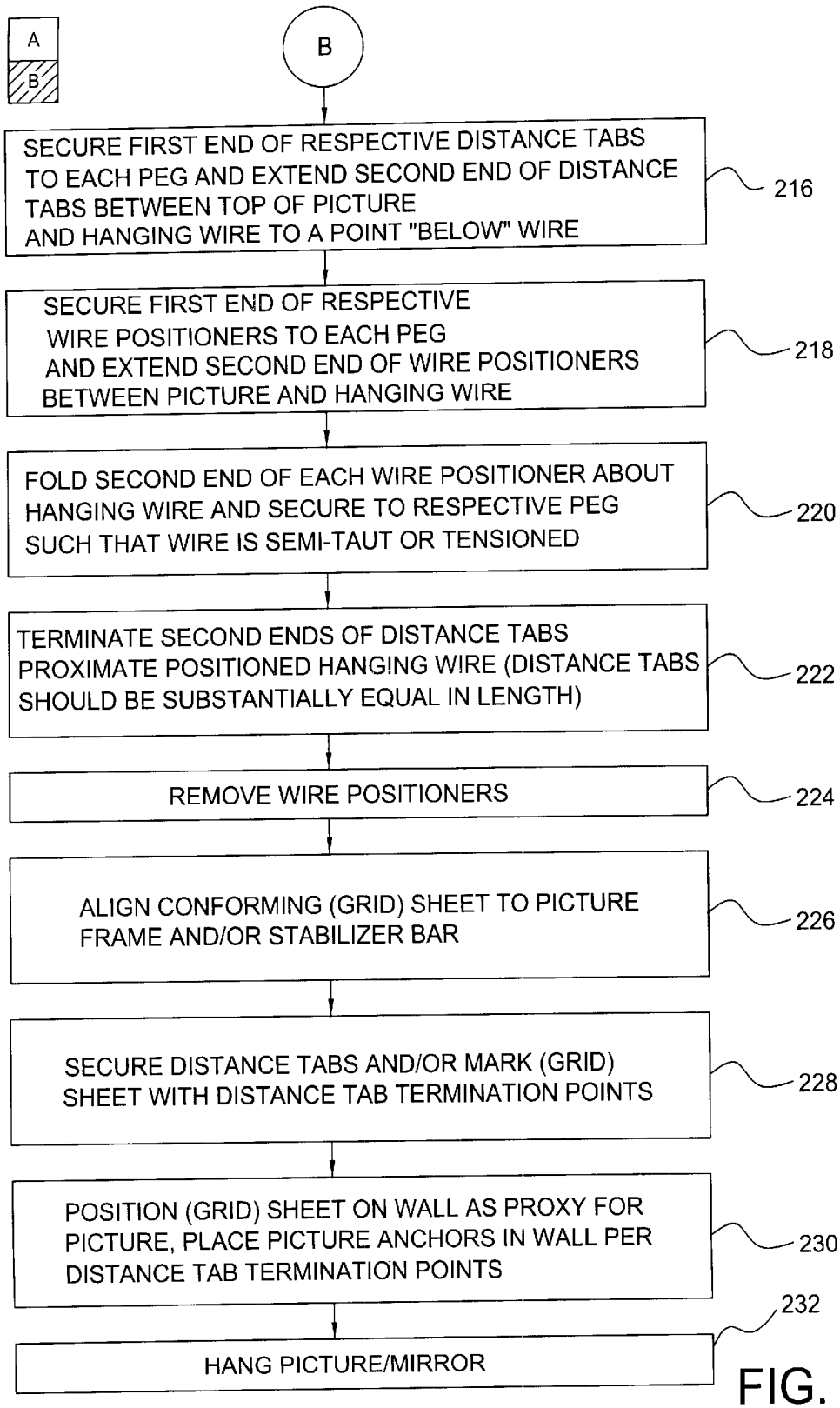

FIG. 2 depicts a flow diagram of a method according to an embodiment of the present invention. Specifically, FIG. 2 depicts a flow diagram of a method 200 for producing an apparatus useful in locating appropriate anchor positions in a wall for securing a wall hanging such as a picture or mirror. It is noted that the method 200 of FIG. 2 allows a single person to hang a picture or mirror without assistance, since the single person may tape or otherwise adhere (preferably using removable tape or other non-permanent adhering technique) to a wall a proxy or representation of the picture or mirror to be hung and then step back from the wall and determine whether the position is suitable (i.e., there is no need for a second person to hold the picture or mirror against the wall). The method 200 of FIG. 2 refers to items discussed above with respect to FIG. 1 which may be provided in the form of a kit.

Figure 3:
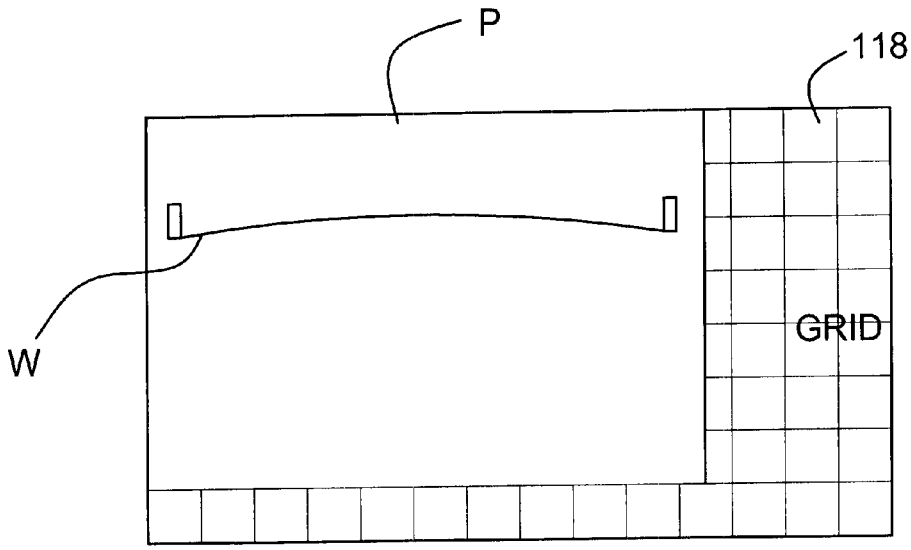
FIGS. 3–12 depict graphical representations of the use of the components shown in FIG. 1.

At step 202, a picture, mirror or other object to be hung on a wall is aligned with a corner portion of a sheet, illustratively a grid sheet 110 formed of paper or other thin sheet material. FIG. 3 depicts a graphical representation of a picture P having a mounting wire W and aligned image side down on a grid sheet 110.

At step 204, the grid sheet is cut in a pattern conforming to the dimensions of the picture to be hung to produce a conforming sheet or grid sheet.

Figure 4:
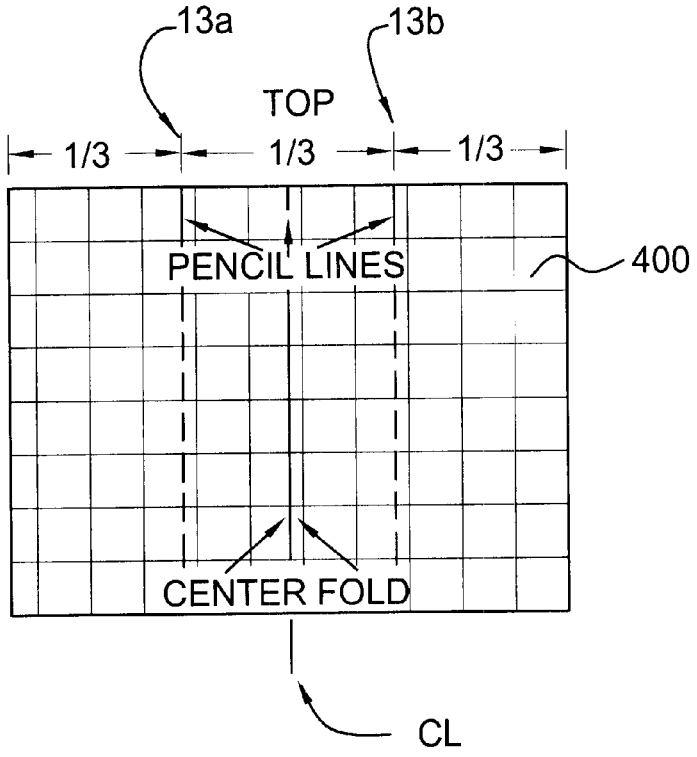

At step 206, a centerline of the conforming or cut grid sheet pattern is established. That is, assuming that the grid sheet has been cut to conform to the shape of a picture to be hung, the centerline established refers to a centerline running "vertically" to the grid sheet if the grid sheet is held against a wall. FIG. 4 depicts a graphical representation of a conforming grid sheet 400 having a centerline CL.

At step 208, "one third" lines of the conforming grid sheet are established. The one third lines of the conforming grid sheet are parallel to the centerline established at step 206. The one third lines represent vertical lines that will subsequently intersect with a wall anchor used to secure the wire on the back of the picture, mirror or other object to be hung. Referring to FIG. 4, one third lines 13A and 13B are shown.

While typically not appropriate, in the case of four or five wall anchors being desirable, one fourth or one fifth lines on the conforming grid sheet are established. It is noted that two vertical lines are used to establish the one third lines, three vertical lines are used to establish the one fourth lines, four vertical lines are used to establish the one fifth lines and so on.

Figure 5:
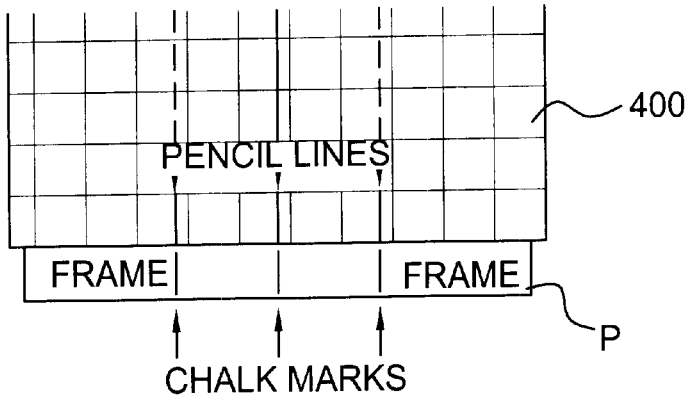

At step 210, the back of the picture or mirror is marked per the established centerline and one third lines. To protect the back or dust cover of the picture or mirror, it is recommended that a chalk marking or other easily removable marking be made. That is, markings of, for example, approximately two inches are made on the back of the picture, mirror or object to be hung to clearly indicate the center and one third lines (or one fourth, one fifth, etc.). Referring to FIG. 4, three pencil lines indicating the centerline CL and one third lines 13A and 13B are shown. FIG. 5 depicts a graphical representation of the conforming grid 400 aligned with the picture frame P such that chalk marks or other indications may be applied to the picture frame in accordance with the center and one third lines provided on the conforming grid 400.

Figure 6:
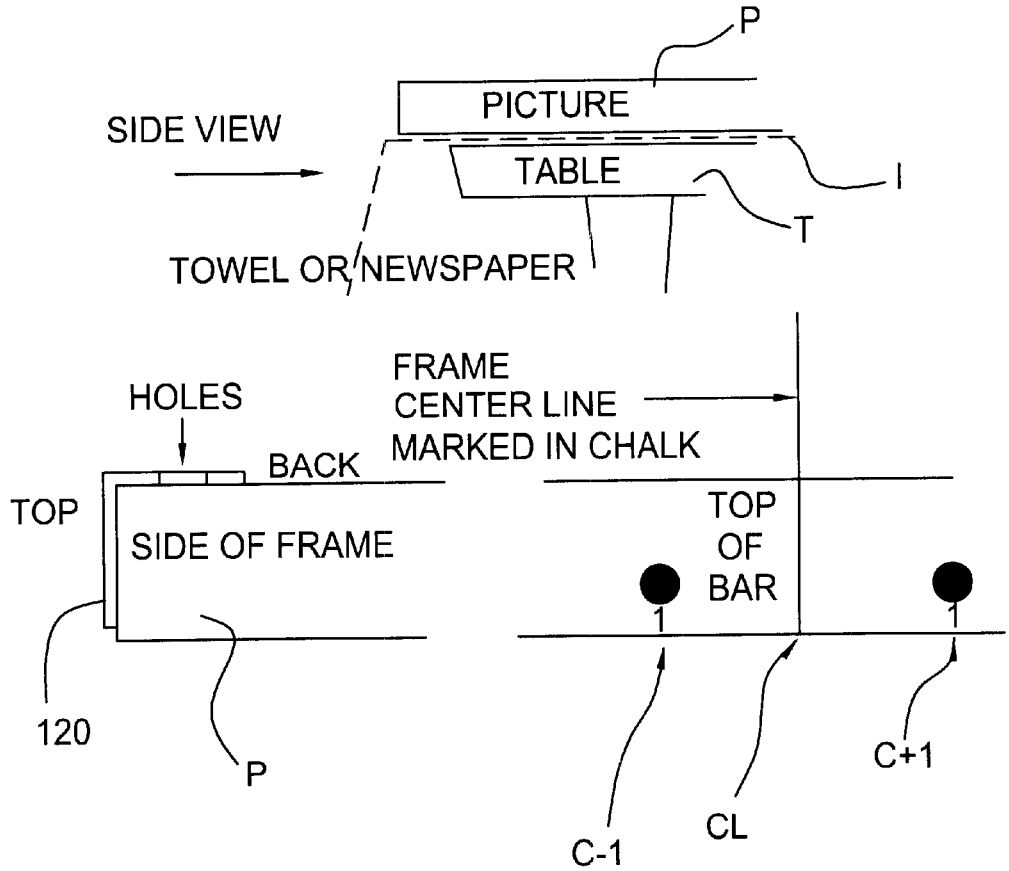

At step 212, the stabilizer bar 120 and the picture are aligned per the respective indicated centerlines. That is, the stabilizer bar 120 described above with respect to FIG. 1 is aligned at an indicated centerline position with the centerline marked on the back of the picture to be hung. FIG. 6 depicts a graphical representation of the picture P placed on a table T with an insulator I therebetween (to avoid scratches). The stabilizer bar 120 is aligned with the picture P such that the portion of the stabilizer including the holes is flush against the back of the picture frame P. and the centerline indicator CL of the stabilizer bar 120 is aligned with the centerline mark placed on the picture frame.

Figure 7:
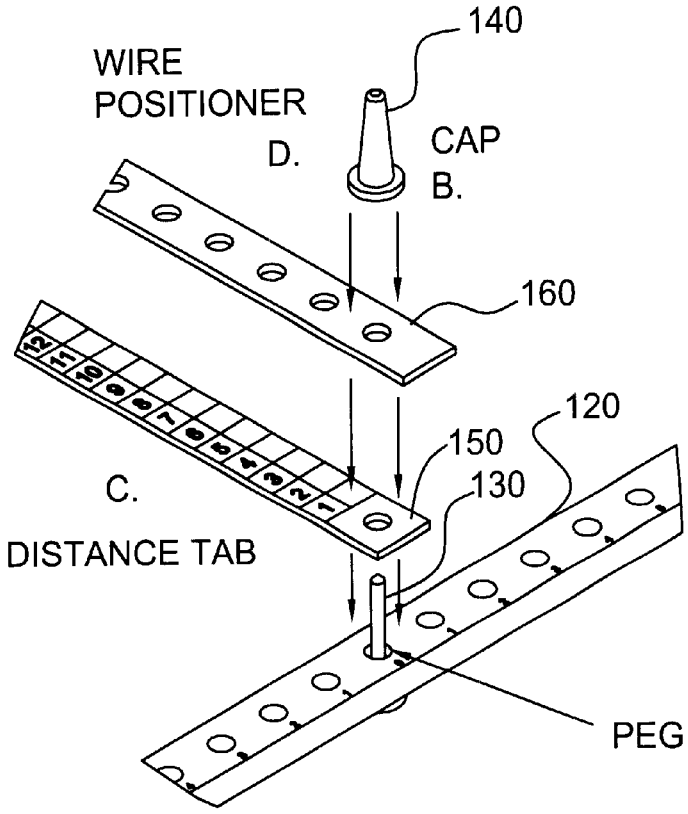

At step 214, a peg is positioned in the single stabilizer holes closest to each of the one third line markings. Thus, two pegs are positioned in the case of an embodiment of the invention utilizing one third lines. FIG. 7 depicts a graphical representation of the stabilizer bar 120 receiving a peg 130 via the appropriate hole. The peg 130 protrudes through the holes of, respectively, distance tab 150 and wire positioner 160 as indicated and described above. Optionally, a peg cap 140 may be placed over the peg 130 to secure the perforated components together.

At step 216, the first end of respective distance tabs (such as described above with respect to FIG. 1) is secured to each peg, while the second end of the respective distance tabs is extended between the top of a picture, mirror or object to be hung and a point "below" the hanging wire which will be used to secure to the wall mounts.

At step 218, the first end of respective wire positioners is secured to each peg (using a peg cap 140, for example) and the second end of the wire positioners is extended between the picture and the hanging wire, such as described above with respect to step 216.

Figure 8:
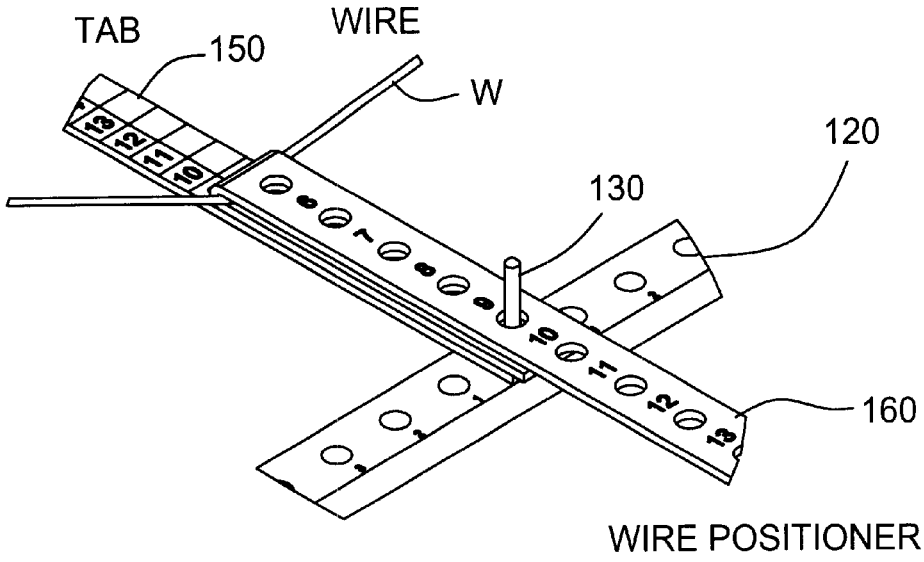

At step 220, the second end of each wire positioner is folded about (or looped over) the hanging wire and secured to its respective peg where it meets the peg to create a semi-taut resistance or tension on the hanging wire. It is noted that each wire positioner will likely be extending beyond its respective peg after folding, such that a hole in the middle portion of the respective wire positioner will be aligned with the respective peg. FIG. 8 depicts a graphical representation of the wire positioner 160 being folded about the wire W and having a second hole receiving the peg 130.

Figure 9:
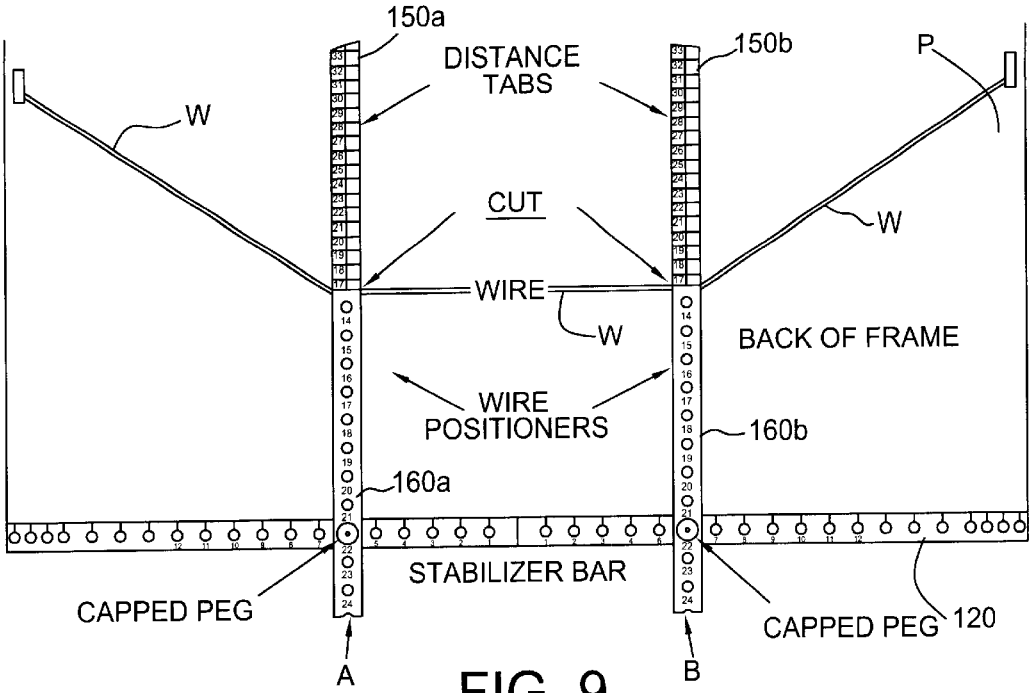

At step 222, the second ends of the distance tabs are terminated proximate the positioned hanging wire. The distance tabs should be substantially equal in length. The distance tabs may be terminated by cutting (preferable), folding or otherwise indicating a terminal length associated with the hanging wire. It is noted that the hanging wire is at least moderately held in place by the two wire positioners described in FIG. 1 and arranged per steps 218 and 220. FIG. 9 depicts a graphical representation of the back of the picture frame P in alignment with the stabilizer bar 120 wherein the wire W is secured via wire positioners 160A and 160B resulting in the protrusion of distance tabs 150A and 150B beyond the wire W. It is noted that the stabilizer bar 120 is intersected by the distance tabs 150 and wire positioners 160 at points A and B, where points A and B represent the one third lines previously discussed. It is also noted that the second ends of the distance tabs should be terminated at the same marking number, such that the distance tabs reflect the same distance.

At step 224, the wire positioners (and any caps) are removed. If caps are used, they are replaced to continue holding the distance tabs.

At step 226, the conforming grid sheet is aligned to the picture frame and/or stabilizer bar. That is, the conforming grid sheet is aligned to the picture frame and the stabilizer bar and distance tabs are placed at the top edge of the picture.

At step 228, the distance tabs are secured and/or marked with the distance tab termination point. For example, in the case of the sheet comprising a grid sheet, the distance tabs may be easily aligned according to the grid lines proximate the respective tabs and secured in place with an adhesive tape (preferably removable) or simply marked. The distance tabs are preferably taped just above (approximately one inch, to allow for the top of a one inch hook or wall fastener to be provided) the termination point or cut.

After completing steps 202 through 228, it is noted that a proxy or representation of the picture, mirror or other object to be hung has been formed, where the proxy includes appropriate respective indication of wall anchor points as well as an appropriate size to assist a decorator in properly aligning the wall hanging with, for example, other wall hangings.

Figure 10:
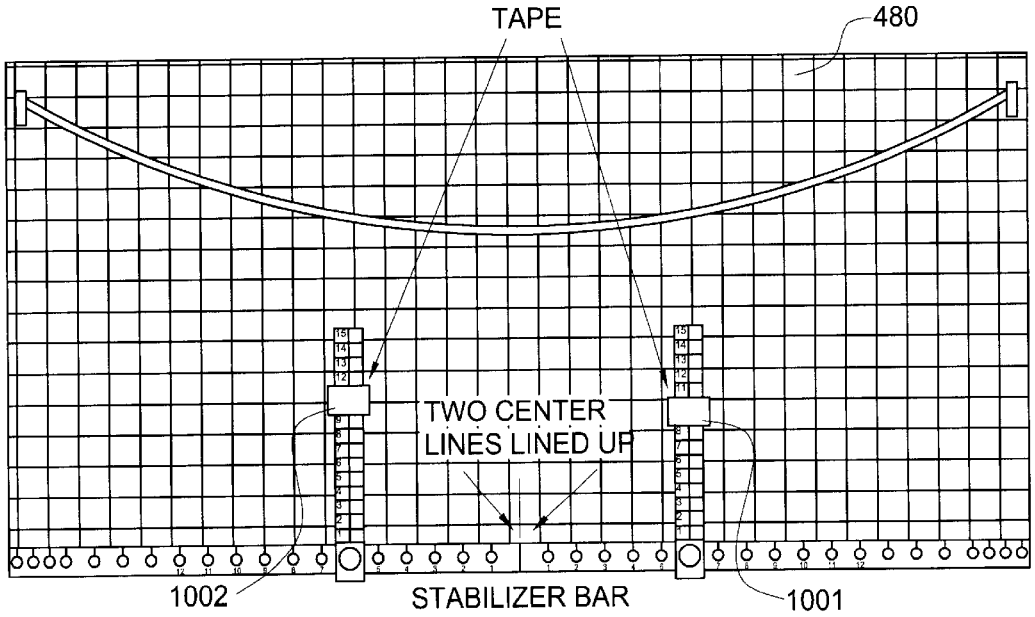
Figure 11:
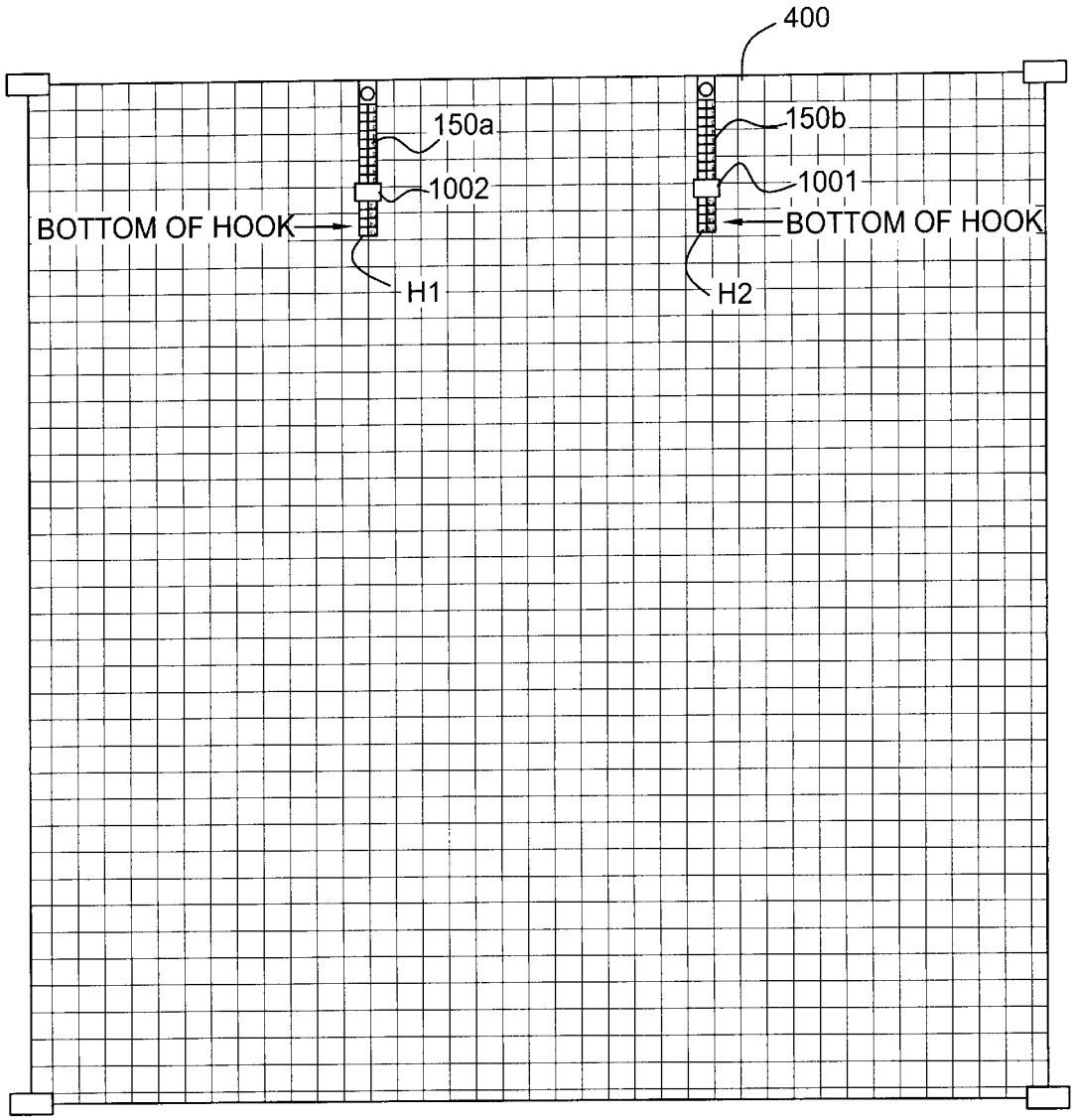
Figure 12:
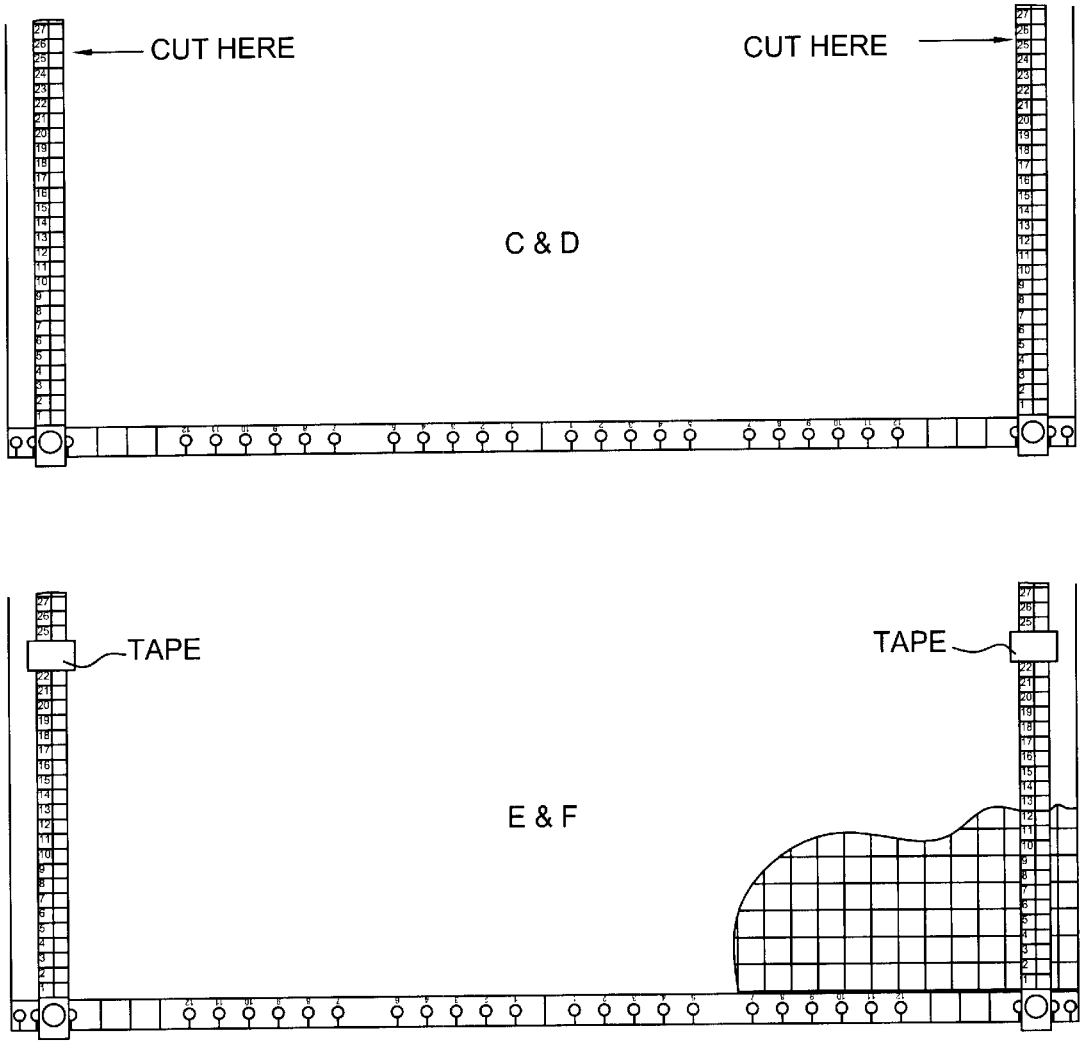

At step 230, the grid sheet is positioned on a wall as a proxy for the picture, mirror or other object to be hung. Picture anchors may be secured in the wall per the distance tab termination points. That is, the distance tab termination points reflect the appropriate wall anchor points where wall anchors are to be inserted into the wall such that the wire attached to the back of the picture, mirror or other object may be used to hang the picture. FIG. 10 depicts a graphical representation of the conforming grid sheet 400 having secured thereon by first 1001 and second 1002 adhesive strips the distance tabs 150B and 150A previously described. Note the alignment of the enterlines in FIG. 10. FIG. 11 depicts a graphical representation of the conforming grid sheet 400 aligned on a vertical surface such as a wall. Two points H1 and H2 proximate the lower termination points of the distance tabs 150A and 150B, respectively, are those points where an anchor such as a nail screw or wall hanging anchor should be inserted into the wall, given that the position of the conforming grid on the wall is appropriate to the picture to be hung.

It is noted that the above-described methods and apparatus may be modified to adapt to hanging a mirror on a wall. This is because a mirror often is hung without the use of a hanging wire, and with the use of mounting brackets that are not horizontally aligned. Thus, the distance tabs are extended from the stabilizer bar to respective mounting brackets on the back of the mirror and terminated. In this manner, a mirror to be hung having mounting hardware that may be totally misaligned may itself be mounted in a horizontally level and vertically true fashion. It is noted that the stabilizer bar 120 preferably includes a series of holes at either end that are specifically intended to receive distance tabs used to align with, and define a distance to, mounting hardware on the back of a mirror.

It is noted that each side of a mirror should be separately processed to determine the appropriate distance tab lengths, since the mounting hardware is often misaligned on mirrors. Also, the mirror (or picture) including such mounting hardware may be much larger than the stabilizer bar.

At step 232, the picture, mirror or other object is hung by causing the hanging wire to cooperate with the wall anchors.

The above-described embodiments of the invention depict a method for producing an apparatus suitable for aligning a picture, mirror or other wall hanging on a wall. In the case of a decorator hanging many objects on a wall, a plurality of the above-described apparatus may be used, such that each wall hanging has associated with it a respective proxy or object-representative apparatus which may be temporarily secured to a wall using removable cellophane tape or other removable adhesive or push pins. By utilizing a plurality of such proxies, a decorator may arrange all of the wall hangings to be used prior to inserting any wall anchors. In this manner, the exact arrangement of the wall hangings may be quickly and easily determined without damaging the wall or wasting time. Advantageously, the system and method of the present invention enable non-decorators to achieve a high level of control in decorating their homes or offices.

In one embodiment of the invention, pre-cut conforming grids including adhered distance tabs and wire positioners are included with a picture, mirror or other object to be hung on a wall. For example, in the case of a manufacturer providing pictures (or mirrors or other wall hanging objects) on a mass-produced basis where the sizes of the pictures are known, the location of the mounting hardware for the hanging wire (or mirror fasteners) is known, and the slack of any hanging wire is known, pre-printed picture representations or proxies according to the present invention may be included with each picture. In this manner, the picture may be easily mounted by a consumer using the picture representative apparatus or proxy to determine the appropriate location of the picture on a wall, prior to compromising the integrity of the wall with a nail, screw or other fastener.

Although various embodiments which incorporate the teachings of the present invention have been shown and described in detail herein, those skilled in the art can readily devise many other varied embodiments that still incorporate these teachings.

What is claimed is:

1. A method, comprising the steps of:

conforming a sheet material to the dimension of a wall hanging;

aligning the conforming sheet material, the object to be hung and a stabilizer bar according to a centerline;

positioning pegs in holes disposed within said stabilizer bar at appropriate anchor line coordinates;

extending respective distance tabs from each of said pegs past a hanging wire of said wall hanging;

adapting said hanging wire to indicate a tensioned wire position;

indicating, using said distance tabs, the intersection of said distance tabs and said hanging in said tensioned position;

said distance tab intersection points indicating respective mounting points for wall anchors.

2. The method of claim 1, wherein said step of adapting comprises the steps of:

extending respective wire positioners from each of said pegs to said hanging wire of said wall hanging; and folding said wire positioner back over said hanging wire such that said hanging wire is tensioned.

3. The method of claim 1, wherein said stabilizer bar comprises an extruded resilient material having equi-distant spaced holes and a centerline indication.

4. The method of claim 1, wherein said distance tabs are terminated at respective intersection points with said hanging wire to form termination points, said termination points being secured to said conforming sheet material.

5. Apparatus for aligning a wall hanging object, comprising:

a sheet material conforming to the dimension of the object, said sheet material including wall anchor mounting points, said wall anchor mounting points determined by tensioning, at two tensioning points, a hanging wire associated with said object and marking said conforming sheet material accordingly.

6. The apparatus of claim 5, wherein said sheet material comprises paper.

7. The apparatus of claim 6, wherein said paper includes markings to visually aid the alignment of said conforming sheet material on a wall.

8. The apparatus of claim 5, further comprising a stabilizer bar, adapted to align at a centerline said sheet material and said wall hanging object, said stabilizer bar including a plurality of markings disposed thereon, wherein two of said markings substantially align with respective one third positions of said wall hanging object.

9. The apparatus of claim 8, further comprising a pair of wire positioners extending from said aligned one third markings on said stabilizer bar to engage said hanging wire such that said hanging wire is tensioned toward said stabilizer bar.

10. The apparatus of claim 9, further comprising a pair of distance tabs extending from said one aligned third markings on said stabilizer bar toward said tensioned hanging wire, said distance tabs being terminated at said tensioned hanging wire to indicate thereby said two wall anchor mounting points.

11. The apparatus of claim 5, wherein said wall hanging object utilizes fixed hanging tabs, said wall anchor mounting points being determined by extending respective distance tabs from a top portion of said conforming sheet material to said fixed hanging tabs.

* * * * *